United States Patent [19]

Lenzen

[11] Patent Number: 4,734,957

[45] Date of Patent: Apr. 5, 1988

[54] FEEDING DUCT

[75] Inventor: Josef Lenzen, Dülmen, Fed. Rep. of Germany

[73] Assignee: Hergeth Hollingsworth GmbH, Dülmen, Fed. Rep. of Germany

[21] Appl. No.: 931,817

[22] Filed: Nov. 18, 1986

[30] Foreign Application Priority Data

Dec. 4, 1985 [DE] Fed. Rep. of Germany ..... 3542816

[51] Int. Cl.[4] ..... D01G 23/04

[52] U.S. Cl. ..... 19/105; 19/304

[58] Field of Search ..... 19/105, 304; 406/23, 406/28, 70

[56] References Cited

U.S. PATENT DOCUMENTS

| | | | |
|---|---|---|---|
| 4,523,351 | 6/1985 | Leifeld | 19/105 |
| 4,657,444 | 4/1987 | Pinto | 19/105 X |
| 4,661,025 | 4/1987 | Pinto et al. | 19/105 X |

FOREIGN PATENT DOCUMENTS

| | | | |
|---|---|---|---|
| 0538067 | 2/1975 | U.S.S.R. | 19/105 |

*Primary Examiner*—Louis K. Rimrodt
*Attorney, Agent, or Firm*—Cort Flint

[57] ABSTRACT

A feed duct (1) for feeding textile fibers to an associated processing machine is disclosed which includes adjustable wall elements (22, 23) to vary the width of the filling chamber (5) of the duct and discharge a fiber web of corresponding width. The adjustable wall elements (22, 23) are displaceable parallel to the side walls (31, 32) of the filling chamber and include lateral wall elements (*22a, 23a*) which are bent and extend through the side walls to also act as holding elements. Setting elements (26, 28 and 27, 29) adjust the setting of the wall elements and the chamber width. In a duct feed having an oscillating plate 39, adjustable wall elements are provided as double wall elements (43, 44) with a pivotal wall part (45, 46) carried between the double walls of each element. An inclined edge (51) of the double wall elements allows oscillating plate (39) to swing with respect to the adjustable width duct for compaction of fiber. A column of fibers may be provided over the entire height of the filling chamber having a uniform width.

14 Claims, 4 Drawing Sheets

FEEDING DUCT

BACKGROUND OF THE INVENTION

The invention relates to an apparatus for feeding fiber material, such as fiber flocks of cotton or the like, by means of a feeding duct to a processing machine, such as a carding machine. The apparatus is the type which feeds fiber material via a spiked feed roller to the feeding duct and removes it from the lower end by delivery rollers. The feeding operation is assisted by an air current which is evacuated through openings in the lower part of the duct walls. A change of width of the fiber material discharged from the duct may be provided by an adjusting member.

It has been known from U.S. Pat. No. 4,523,351 (German Pat. No. 31 49 965) that the working width for the fiber flock guidance is set by providing in the feeding duct at least one adjustable wall element adjustable at an angle from the side wall and obliquely pointing downwardly. In each angle position, the wall element is the hypotenuse of a triangle defined by the side wall of the duct and delivery rollers. Such as adjusting member entails difficulties in providing a uniform and homogeneous column of material in the feeding duct and of the delivery to the delivery rollers which affects the homogeneity of the fibrous web supplied to the processing machine.

Accordingly, an object of the invention is to provides a means for adjusting the width of a fiber flock web discharged from a feeding duct with homogeneous filling of the feeding duct so that, even with a modified width, a homogeneous fibrous web composed of the fiber flocks is positively discharged from the feeding duct.

SUMMARY OF THE INVENTION

The invention is characterized in that the adjustable member used is at least one wall element displaceable in parallel to the side wall of the feeding duct, the upper end of the wall portion being held by means of a lateral element while its central region is held at the side wall of the feeding duct by means of a holding member.

Due to such an adjustable member design, it is ensured that the width of the total height of fibers in the feeding duct remains constant from the feed roller to the deliver roller, subject to the adjusted width of the feeding duct. Further, a uniform distribution of the fiber flocks in height and width of the corresponding feeding duct volume set is achieved with a resultant uniformly condensed flock column along the height of the feeding duct. At the delivery rollers, the fibrous web is adjusted in its respective width and is best characterized by its uniform, continuous and homogeneous quality. In other words, the fibrous web produced by the duct feed gives the impression that, from the beginning, the feeding duct had been originally constructed with the adjusted width filled with fiber flocks.

The lateral element of the adjustable wall element should extend horizontally or nearly horizontally, or parallel to the axis of the feed roller beneath the latter. Quite unexpectedly, it has been found that fiber flocks do not heap up or rest on the lateral element because the air current caused by the rotating feed roller regularly blows the fiber into the duct having downwardly directed parallel walls. Thus, the homogeneity of the filling of the feeding duct is not affected by the lateral wall element.

According to another feature of the invention, in case of a feeding chute in which the front or rear wall are of the oscillating type, the adjustable wall element is of a double-wall design. An intermediate wall portion is pivotally positioned within the double wall. Further, corresponding to the movement of the oscillating wall, the adjustable wall element may be inclined.

Due to this configuration of the adjustable wall element, it is possible to also change, in the case of an oscillating duct, the width of the fiber material discharged from the duct. The oscillating wall of the feeding duct operates with an adjustable width feeding duct chamber defined by parallel side walls, and the resultant densification and distribution of the fiber flocks is uniform over the width of the feeding duct. The fiber flocks are homogeneously condensed in the duct so that the fibrous web discharged from the duct is of a perfect uniform and homogeneous quality having a high density. The infinite adjustability of the width of the feeding duct is maintained with unchanged conditions.

The intermediate wall portion within the double wall is provided in a suitable pivot arrangement and may be under spring action to ensure that, even in case of an actuated oscillating wall, the sides of the duct adjusted in width are closed to prevent fiber flocks from escaping laterally from the duct.

According to another feature of the invention, the adjustable wall element with holding elements and associated fixed side walls may be provided in the form of an independent constructional casing unit. The casing unit which includes the side wall supporting the adjustable wall elements may be attached to the duct side wall in a removable manner. Thus, the feeding duct may be used either with the adjustable wall element or without it as well depending on the fibrous web to be produced.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 shows a schematic longitudinal section of the feeding duct with oscillating wall, and FIG. 5 is a cross-section along line V—V of FIG. 4.

DESCRIPTION OF A PREFERRED EMBODIMENT

Figure 1:
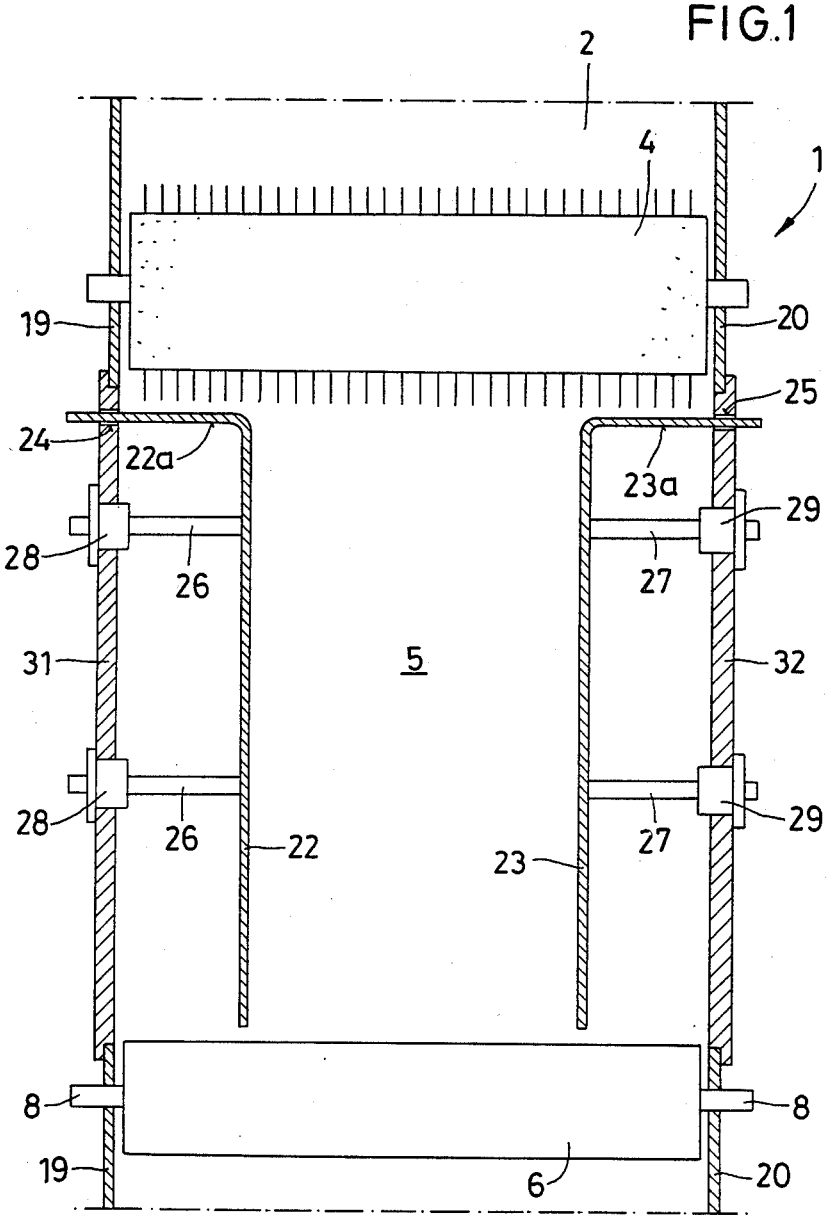
FIG. 1 is a schematic illustration of a longitudinal section and detail of one embodiment of the feeding duct of the invention comprising filling duct adjustable side wall elements displaceable in parallel.
Figure 2:
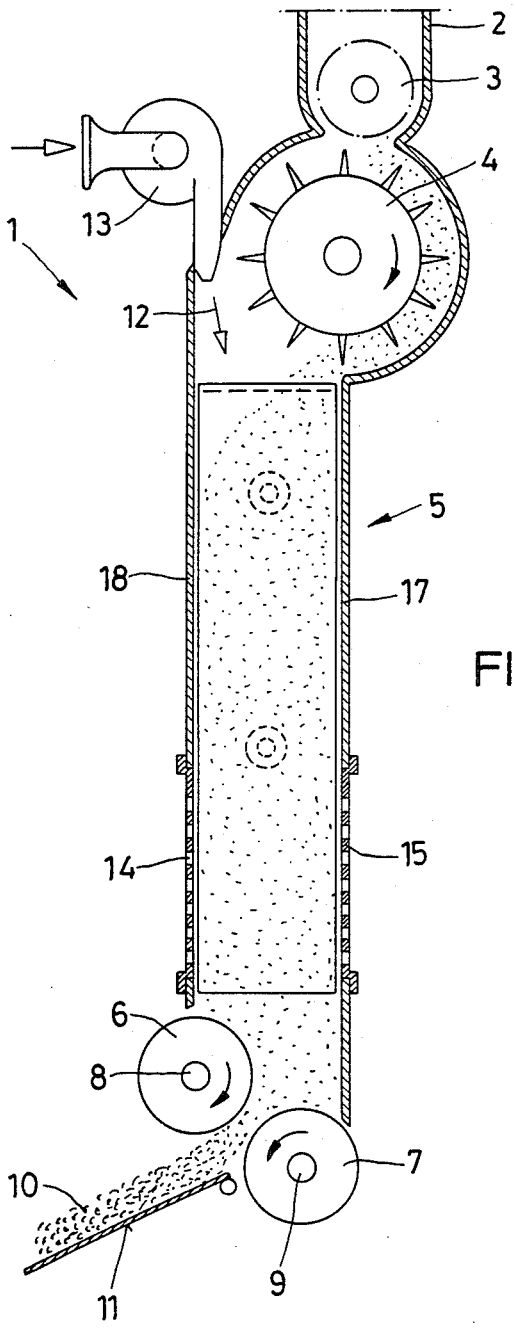
FIG. 2 is a schematic side view and longitudinal section of the feeding duct of FIG. 1.

Referring now in more detail to the drawings, a feeding duct, designated generally as 1, is used to feed fiber material, such as fiber flocks of cotton, etc. to a processing machine (non-illustrated), such as a carding machine. The fiber material in a reservoir 2 is conveyed via a feed roller 3 and an opening and beating roller 4 to a filling chamber, designated generally as 5, of the feeding duct 1. The lower end of the filling chamber is provided with a pair of delivery rollers 6 and 7 positioned rotatably by shafts 8 and 9 to discharge a fibrous web 10 via a chute 11 to the processing machine. The fibrous web delivery in the filling chamber 5 may be assisted also by an air current 12 effective preferably over the filling duct width by means of a blowing fan 13. The blowing air flows out at the lower end of the filling duct through perforated plates 14 and 15 arranged to allow air to escape after having assisting in the compaction of fibers in the filling chamber.

Figure 3:
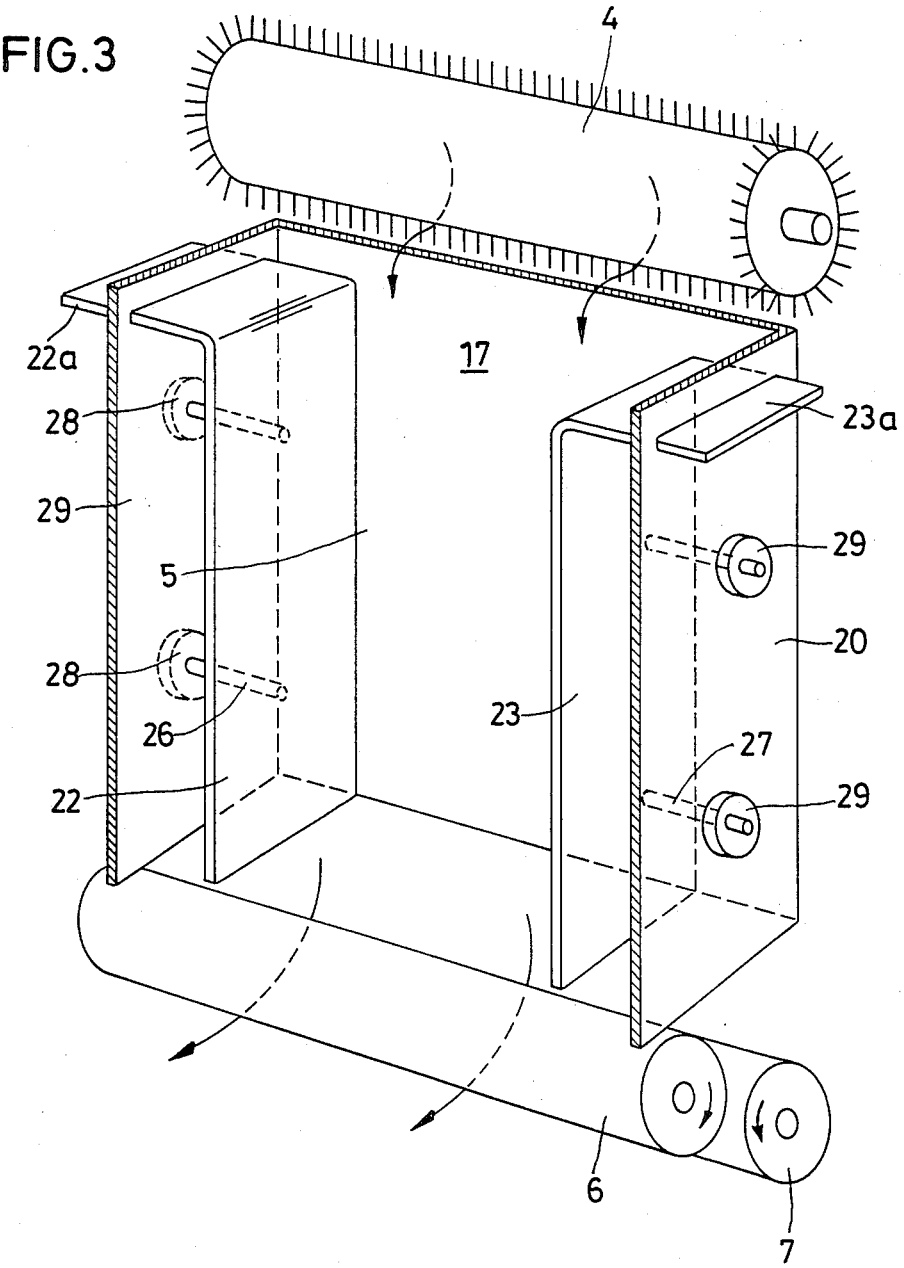
FIG. 3 is a perspective view of the feeding duct of the invention according to FIG. 1, the front wall of the duct being omitted.

The filling chamber 5 is defined by a rear wall 17, a front wall 18 and integral side walls 19 and 20. To illustrate more clearly the feeding duct, its front wall 18 is omitted in FIG. 3.

To change the width of the fibrous web 10 leaving the filling chamber 5, at least one displaceable wall member 22 and/or 23 is provided as an adjustable wall element movable in parallel to one side wal 19 or 20 of the feeding duct 1. The upper ends of the wall elements 22, 23 are provided with lateral wall elements in the form of a bent portion **22*a*, 23*a* traversing an opening 24, 25 of the side wall which simultaneously acts as a holder. Further holders for the wall elements 22 and 23 displaceable in parallel to the side walls of the filling chamber may be provided in the form of setting elements 26, 27 which, for example, may consist of thread bolts welded to the movable wall parts 22, 23 and engaging nuts 28, 29** conveniently positioned in the side wall.

Thus, a parallel movement of the displaceable wall elements 22, 23 relative to the side walls 19, 20 of the feeding duct 1 may be performed by simple means. Setting members 26, 27 may be of such a length as to permit to shift wall parts 22, 23 nearly to the center of the filling chamber 5.

The bent latral wall elements **22*a*, 23*a* of the displaceable wall elements 22, 23 conveniently extend horizontally or nearly horizontally. Fiber flocks may not be deposited or heaped on the lateral wall elements because by the beater roller 4 acting like a fan, an air current is produced which sweeps the fiber flocks from elements 22*a*, 23*a* into the filling chamber 5**.

In case of any adjustment of the setting members, the volume of the filling chamber is defined by parallel walls over the total height. Thus, a uniform filling height of the filling chamber 5 and a uniform discharge of the fiber flocks in the form of a fibrous web 10 by means of the delivery rollers is ensured. With each setting of the displaceable wall elements 22, 23, the resultant fibrous web consists over its total width of homogeneously distributed flocks.

As evident from FIG. 1, the setting members together with the holding elements and the associated wall section of the feeding duct conveniently form a construction casing unit. The holders and setting members **22*a*, 26, 28, or 23*a*, 27, 29 for the displaceable wall element 22 or 23 are provided at a casing side wall section 31 or 32 which forms an independent part relative to the fixed side walls 19, 20** of the feeding duct. The casing unit may consist of the adjustable wall elements, the holder elements, and the casing side wall sections.

Side wall sections 31, 32 of the casing unit carrying the adjusting wall elements 22, 23 with the holding elements 26, 27 are designed as cover members which are removably secured to side wall 19, 20 thus allowing the device for limiting the width of the fibrous web to be optionally mounted to the customary feeding duct.

Figure 4:
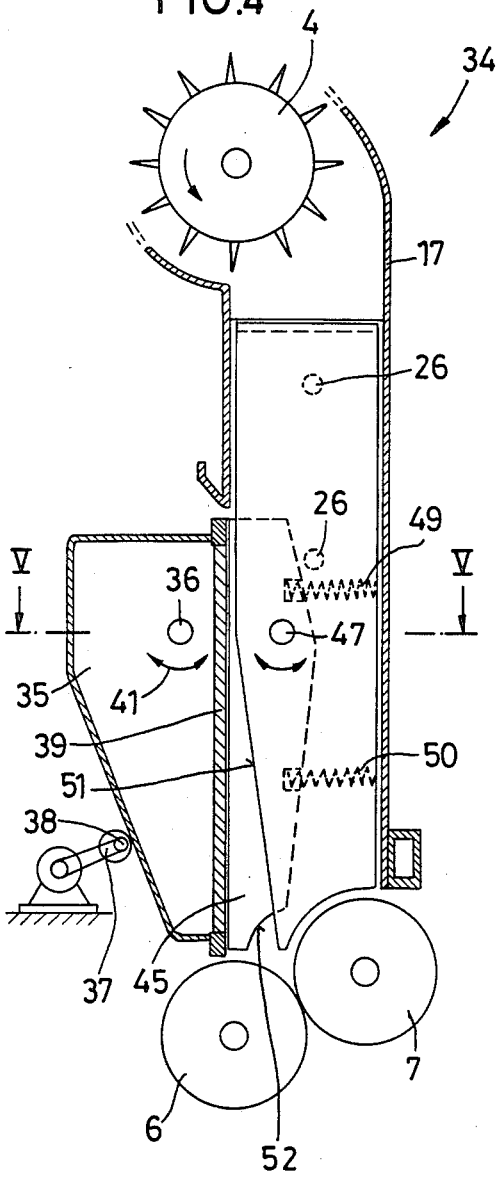
FIGS. 4 and 5 schematically illustrate another embodiment of the feeding duct of the invention for producing an adjustable width of a fibrous web in connection with an oscillating plate for the better compacting of the duct filling.
Figure 5:
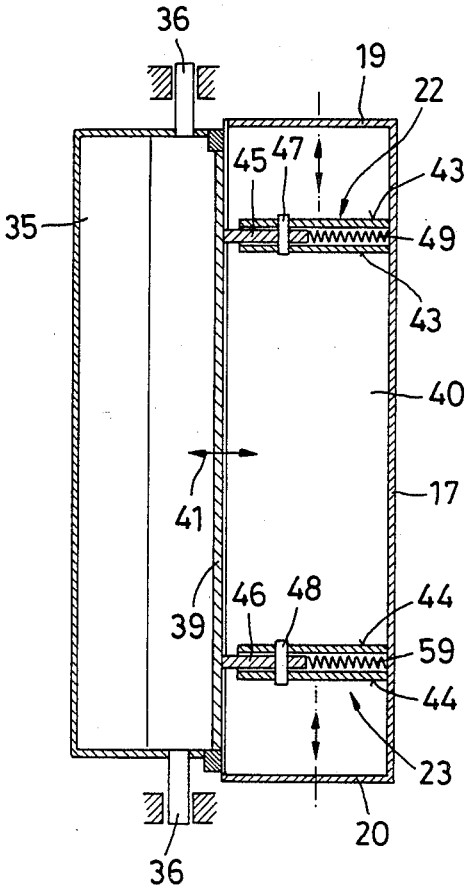

The embodiment of the feeding duct of FIGS. 4 and 5 relates to a so-called oscillating chute 34 having provided at its front side an oscillating body 35 which is positioned pivotally about a shaft 36. The drive is affected by an eccentric 37 supported pivotally about shaft 38. The oscillating body 35 comprises a so-called oscillating plate or wall 39 which, during the oscillating movement swings into the filling chamber 40, such as indicated by arrow 41, subjecting the fiber material in the filling chamber 40 to a condensing effect.

The adjustable wall elements 22, 23 used with an oscillating chute are of a double wall design provided by wall elements 43 and 44 being combined to form displaceable wall elements. Within double walls 43 or 44, an intermediate wall part 45 or 46 is positioned rotatably about shafts 47 or 48 enabling the intermediate wall part 45, 46 to yield responsive to the movement of the oscillating wall 39 of body 35. At the same time, the intermediate wall parts 45, 46 are under the action of springs 49, 50 which ensure a swing-back corresponding to the return movement of the oscillating wall 39 as well as a tight application of the intermediate wall part and oscillating wall 39. The displaceable double wall part 43, 44 are provided with an inclined edge 51 corresponding to the amplitude of the oscillating wall 39. Further, the lower region of the double wall parts 43, 44 may be fitted with a recess 52 in accordance with the contour of delivery roller 7.

The free triangle left at the inclination 51 is so small that during oscillation a lateral escape of the fiber flocks is negligible.

It is preferred that the intermediate wall parts 45, 46 be made of plastic in order to allow a frictionless sliding within the double wall 43, 44, but another material such as brass may be used as well, provided its sliding property is satisfactory for steel.

In spite of the provided oscillating body 35, an optional adjustment of the wall elements 43, 44 is possible. The oscillating movement does not affect the arrangement of the movable wall elements 43, 44. On the contrary, the oscillating movement of body 35 is well-taken into account by the specific configuration of the adjustable wall elements 43, 44. The filling chamber 40 in this embodiment is also defined by vertical wall part 17, 43, 44, 39. As to the production of a homogeneously spread fibrous web, the same advantages are provided as in case of the first embodiment. The adjustable wall elements 43, 44 including a lateral upper portion, may form a mounting unit just as in case of the embodiment of FIG. 1. There is no difficulty to additionally apply a blowing air current for assisting in delivering and compacting fiber material in the feeding duct. If so, exit openings for air must be provided at the lower end of the oscillating wall or of the rear wall of the duct.

While a preferred embodiment of the invention has been described using specific terms, such description is for illustrative purposes only, and it is to be understood that changes and variations may be made without departing from the spirit or scope of the following claims.

What is claimed is:

1. Apparatus for feeding textile fiber material by means of a feed duct to a textile processing machine in which fiber material is fed by a feed roller to a feed duct and is removed from the lower end of the feed duct by delivery rollers, the feeding of the fiber material being assisted by an air current which is evacuated through openings in the lower end of the duct and an adjusting member is provided to change the width of the fiber material discharged from the duct, said feed duct having a back wall, a front wall, and integral side walls adjoining said front and back walls, wherein said apparatus comprises at least one adjustable wall element which is disposed vertically in said feed duct transverse to said front and back walls and is displaceable in parallel to a side wall of said feed duct the upper end of said wall element being held by means of a lateral element and at least one setting member holding a central region of said adjustable wall element adjacent said side wall of the feed duct; and wherein said wall element extends along the effective height of the duct generally from said feed roller to said delivery rollers.

2. Apparatus according to claim 1 wherein said lateral element of said adjustable wall portion is generally horizontal.

3. Apparatus according to claim 1 wherein said back wall of said feeding duct includes an oscillating adjustable plate and adjustable said wall element includes a double wall assembly, an intermediate wall arranged pivotally with respect to said double wall assembly, and said adjustable wall element includes an inclined surface contoured to accommodate the oscillating movement of said oscillating plate.

4. Apparatus according to claim 3 wherein said double wall assembly includes a pair of spaced walls, said intermediate wall being pivotally disposed between said spaced walls, and biasing means acting upon said intermediate wall.

5. Apparatus according to claim 3 wherein each said adjustable wall element includes a double wall assembly which includes a pair of spaced walls, said intermediate wall being pivotally disposed between said spaced walls.

6. Apparatus according to claim 1 wherein said feed duct includes fixed side walls and said apparatus includes a constructional casing unit which includes removable casing unit sides which may be removably affixed to said fixed side walls, said adjustable wall elements, lateral element, and setting members being carried by said casing unit sides.

7. Apparatus for feeding textile fiber material by means of a feed duct to a textile processing machine in which fiber material is fed by a feed roller to a feed duct and is removed from the lower end of the feed duct by delivery rollers, the feeding of the fiber material being assisted by an air current which is evacuated through openings in the lower end of the duct and an adjusting member is provided to change the width of the fiber material discharged from the duct, said feed duct having a back wall, a front wall, and integral side walls adjoining said front and back walls, wherein said apparatus comprises:

at least one adjustable wall element carried in said feed duct parallel to said side walls of said feed duct transverse to said front and back walls and being movable parallel to said side walls to adjust a width of said feed duct;

an oscillating plate for compacting fibers in said feed duct pivotally carried by said back wall of said feed duct in a manner that said oscillating plate pivots toward and away from said adjustable wall element to create a space therebetween when said oscillating plate swings away from said adjustable wall element; and a pivotal wall part pivotally carried in said feed duct cooperating with said adjustable wall element to accommodate the pivotal motion of said oscillating plate and close said space to prevent fiber removal through said space.

8. The apparatus of claim 7 wherein said pivotal wall element is pivotally carried by said adjustable wall element.

9. The apparatus of claim 7 wherein said adjustable wall element has a rear inclined edge to accommodate pivotal movement of said oscillating plate towards said adjustable wall element.

10. The apparatus of claim 7 wherein said adjustable wall element includes a lateral wall element adjacent a top portion of said adjustable wall element which extends generally parallel to said feed roller.

11. The apparatus of claim 7, wherein said wall element extends along the effective height of the duct generally from said feed roller to said delivery rollers.

12. Apparatus for feeding textile fiber material by means of a feed duct to a textile processing machine in which fiber material is fed by a feed roller to a feed duct and is removed from the lower end of the feed duct by delivery rollers, the feeding of the fiber material being assisted by an air current which is evacuated through openings in the lower end of the duct and an adjusting member is provided to change the width of the fiber material discharged from the duct, said feed duct having a back wall, a front wall, and integral side walls adjoining said front and back walls, wherein said apparatus comprises:

a pair of adjustable spaced apart wall elements disposed generally parallel to said side walls of said feed duct transverse to said front and back walls and carried in said feed duct in a manner that said wall elements are displaceable in parallel to said side walls;

said wall elements extending along the effective height of the duct generally from said feed roller to said delivery rollers;

an upper end of said wall elements including a lateral element extending through a portion of said duct wall; and at least one setting member holding said adjustable wall element adjacent said side wall of the feed duct in a set position to provide a desired width between said wall elements.

13. Apparatus according to claim 12 wherein said lateral element of said adjustable wall portion is generally horizontal.

14. Apparatus according to claim 12 wherein said back wall of said feeding duct includes an oscillating adjustable plate and each said adjustable wall element includes an intermediate wall arranged pivotally with respect to said adjustable wall element, and said adjustable wall element includes an inclined surface contoured to accommodate the oscillating movement of said oscillating plate.

* * * * *